US006724998B2

(12) United States Patent
Regelsberger et al.

(10) Patent No.: US 6,724,998 B2
(45) Date of Patent: Apr. 20, 2004

(54) IMAGE FORMING APPARATUS WITH VARIABLE TONING BIAS OFFSET SERVICE UTILITY

(75) Inventors: Matthias Regelsberger, Rochester, NY (US); David Hockey, Brockport, NY (US); Anne Lairmore, Hilton, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/810,785

(22) Filed: Mar. 16, 2001

(65) Prior Publication Data

US 2001/0036372 A1 Nov. 1, 2001

Related U.S. Application Data

(60) Provisional application No. 60/190,434, filed on Mar. 17, 2000.

(51) Int. Cl.[7] ..... G03G 15/06

(52) U.S. Cl. ..... 399/55; 399/50; 399/66

(58) Field of Search ..... 399/9, 15, 18, 399/29, 31, 49, 50, 55, 56, 66, 72

(56) References Cited

U.S. PATENT DOCUMENTS

| | | | | | |
|---|---|---|---|---|---|
| 4,319,544 | A | | 3/1982 | Weber | 118/647 |
| 5,202,726 | A | * | 4/1993 | McCulley et al. | 399/11 |
| 5,373,351 | A | * | 12/1994 | Umeda et al. | 399/66 |
| 5,559,578 | A | * | 9/1996 | Umeda et al. | 399/50 |
| 5,613,047 | A | * | 3/1997 | Shimomura et al. | 399/9 X |
| 5,970,279 | A | * | 10/1999 | Sakaizawa et al. | 399/46 |
| 5,970,280 | A | | 10/1999 | Suzuki et al. | 399/55 |
| 5,987,271 | A | | 11/1999 | Regelsberger et al. | 399/58 |
| 6,125,245 | A | * | 9/2000 | Shibuya et al. | 399/49 |
| 6,128,449 | A | * | 10/2000 | Zenba et al. | 399/50 |

* cited by examiner

*Primary Examiner*—Hoan Tran
(74) *Attorney, Agent, or Firm*—Richard A. Romanchik

(57) ABSTRACT

An electrophotographic print engine has a variable primary charger and toning bias which places the machine in abnormal reproduction modes in order to provide service and diagnostic information to troubleshoot subsystems involved in the electrophotographic process.

19 Claims, 4 Drawing Sheets

IMAGE FORMING APPARATUS WITH VARIABLE TONING BIAS OFFSET SERVICE UTILITY

Reference is made to, and priority claimed from U.S. Provisional Application Ser. No. 60/190,434 filed Mar. 17, 2000 entitled "IMAGE FORMING APPARATUS WITH VARIABLE TONING BIAS OFFSET SERVICE UTILITY".

FIELD OF THE INVENTION

The present invention relates to an image forming apparatus, and particularly to a method and a device for providing variable film voltage and toning bias offset for machine diagnostic capability.

DESCRIPTION OF THE RELATED ARTS

Electrophotography refers to producing photographic images by electrical means and can be used for copying documents and other graphic matter. Electrophotographic print engines are well known to those skilled in the art and are extensively used in a variety of environments, such as offices, libraries, and educational institutions.

Electrophotographic print engines are comprised of a number of subsystems, one of which is best described as the electrophotographic imagery subsystem. In this system, a light source forms an electrostatic latent image of an original document on a photosensitive medium. The photosensitive medium, as it moves within the print engine, travels adjacent to a source of tiny plastic particles called toner. The electrostatic force of the latent image on the photosensitive medium attracts the toner, thereby providing a developed image of toner particles on the surface of the photosensitive medium. The toner image is transferred through electrostatic charges to an image receptor, which is normally a sheet of paper or plastic. The image receptor then passes through a fuser which heats and melts the toner particles, thereby fixing or fusing the image of the original onto the image receptor.

As described above, several operational steps are involved in the electrophotographic imagery subsystem and include what can be described as charge, expose, tone and transfer steps. All of the steps in the electrophotographic imagery subsystem must work together properly in order to provide consistent image quality.

When the image quality of a print engine does not meet expectations due to the presence of subsystem problems, a service engineer must determine the root cause of the problem before adequately servicing the print engine. Many image uniformity issues can originate from the charging, exposure, development, transfer or cleaning subsystems. Without proper diagnostic tools, it can be difficult to diagnose the subsystem causing the loss of image quality performance.

Efforts regarding servicing such systems have led to continuing developments to improve their versatility, practicality and efficiency.

SUMMARY OF THE INVENTION

An object of the present invention is to provide an image forming apparatus comprising: a primary charger for providing a primary charging voltage on an image support; an image support for supporting an electrostatic latent image on the surface thereof; a developing unit having a developing agent support, the developing agent support retaining a developing agent, including toner and carriers, contained in the developing unit, and the developing unit converting the latent image on the image support into a toner image by causing the toner to adhere to the surface of the image support; a developing bias supplying unit for supplying a developing bias voltage to the developing agent support of the developing unit; and, a controller for controlling the developing bias supplying unit and primary charger to provide the primary charging voltage and developing bias voltage at predetermined values in order to provide diagnostic information on the image forming apparatus.

Another object is to provide a method of operating an image forming apparatus comprising the steps of: providing a primary charging voltage on an image support; supporting an electrostatic latent image on the surface of the image support; causing toner of a developing agent to adhere to the surface of the electrostatic latent image to thereby convert the latent image on the image support into a toner image; supplying a bias voltage to the developing agent; and setting the bias voltage and primary charging voltage to predetermined values in order to provide diagnostic information on the image forming apparatus.

Another object of the present invention to provide an electrophotographic print engine having a variable primary charger and toning bias offset in order to provide the necessary service and diagnostic information to troubleshoot all subsystems involved in the electrophotographic process (from photoconductor maintenance image formation to image fixation onto the output receiver). To this end, the present invention allows the electrophotographic process to be operated with parameters otherwise undesirable for the print production mode. Specifically, the present invention allows the toning of the image loop without using an exposure step. The operator can use the output created by the present invention to differentiate between exposure issues and other sources of process non-uniformities to thereby analyze the health of the various subsystems of the print engine.

The present invention provides an image forming apparatus having an image support for supporting an electrostatic latent image on a surface of the image support; a developing unit having a developing agent support, the developing agent support retaining a developing agent, including toner and carriers, contained in the developing unit, and the developing unit converting the latent image on the image support into a toner image by causing the toner to adhere to the surface of the image support; a developing bias supplying unit for supplying a developing bias voltage to the developing agent support of the developing unit; and a controller for setting the developing bias voltage, for imaging or service diagnostics.

These and other objects, features and advantages of the present invention will become more apparent in the light of the detailed description of exemplary embodiments thereof, as illustrated by the drawings.

DETAILED DESCRIPTION

Various aspects of the invention are presented in the Figures, which are not drawn to scale and wherein like components in the numerous views are numbered like. The various components presented and described with reference to the Figures may be altered or substituted with other types of components suitable for use within an electrographic print engines, as may be desired for a particular application, without departing from the invention. It is not intended to limit the invention to the specific embodiments presented herein, as they are representative of the inventive concepts defined by the claims appended hereto.

Figure 1:
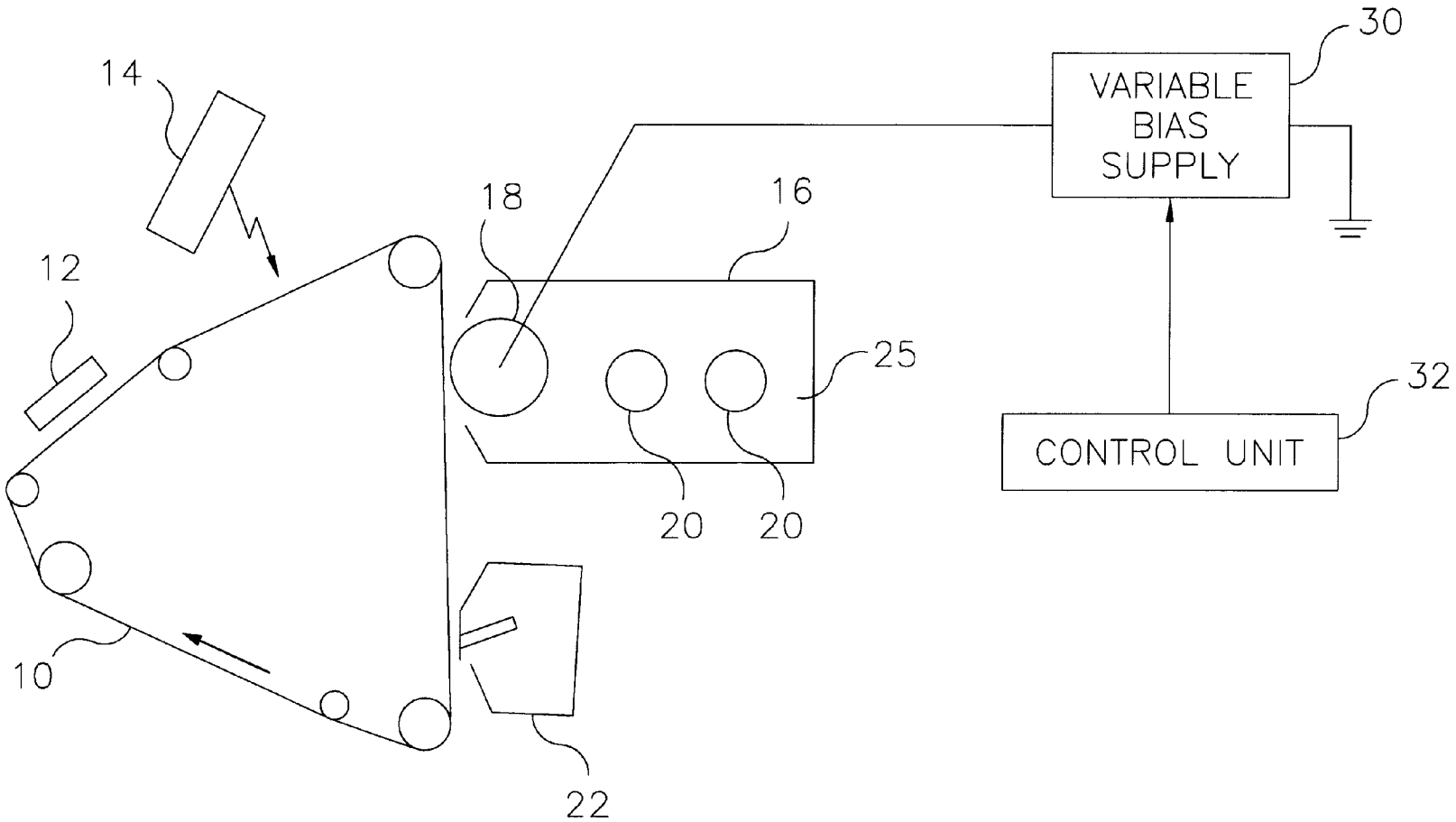
FIG. 1 is a schematic diagram of an electrophotographic imaging apparatus in accordance with the present invention.

Referring now to FIG. 1, an image forming apparatus according to the invention includes an image support, such as a photosensitive film 10 which serves as an image bearing member on which an electrostatic latent image or pattern is formed. A primary charger 12 provides a predetermined primary charging voltage to the image support 10. During this "charge" step, an electric corona, ion-rich field is introduced by the primary charger proximate with the photoconductive surface of the film. The resulting current flow produces an accumulation of electric charge in the electrochargeable surface of the film. After a finite time lapse, charging action is terminated, whereupon an integratively accumulated resident charge will remain, the potential value of which is intrinsic with the elements comprising the electrochargeable surface, in a manner not unlike that of a charged electric capacitor.

An exposure unit 14 converts an original image into digital data which is used to drive an electronic exposure device such as an LED array or a semiconductor laser, which forms the electrostatic latent image on the photosensitive film 10.

A developing unit 16 develops the electrostatic latent image formed on the photosensitive film. The developing unit is provided with a developing roller 18 and mixing screws 20. A developing agent 25, including powdered toner and carriers, is contained in the developing unit 16. The developing roller or sleeve 18 contains a magnet (not shown) therein. A magnetic brush is formed on the surface of the roller 18, and the developing unit 16 is arranged such that the brush is placed adjacent to the surface of the photoconductive film 10. Magnetic brushes are well known in the art. A further description can be found in ELECTROPHOTOGRAPHY AND DEVELOPMENT PHYSICS, by L. B. Schein, © Springer-Verlag Berlin Heidelberg 1988, and ELECTROPHOTOGRAPHY, by R. M. Schaffert, M. A. Ph.D., Focal Press London © 1975 Focal Press Limited, the contents of which are hereby fully incorporated herein by reference. The developing agent 25 is retained and carried by the brush of the developing roller 18. Hence, the developing roller 18 serves as the developing agent support which retains and carries the developing agent 25. Mixing screws 20 mix the developing agent 25 within the developing unit 16.

An electric field between the photoconductor and the sleeve of the developing roller is produced by supplying a developing bias voltage to the sleeve using a variable developing bias supply unit 30. This toning bias is a supplementary electric field which serves to electrically enhance the migration of the toning particles so that the toner selectively adheres to the surface of the photoconductor due to the electric field to form a toner image according to the latent image, and then the toner image is transferred to a receiver, such as blank paper to form the image. Toning in this manner is well known and is described with detail in U.S. Pat. No. 4,076,406 entitled METHOD OF AND APPARATUS FOR TONING ELECTROPHOTOGRAPHIC FILM; U.S. Pat. No. 4,319,544 entitled DIGITALLY SYNTHESIZED DYNAMIC BIAS METHOD AND APPARATUS FOR TONING CONTROL IN DEVELOPING LATENT ELECTROPHOTOGRAPHIC IMAGES; and U.S. Pat. No. 5,987,271 entitled METHOD AND APPARATUS FOR CONTROL OF VARIABILITY IN CHARGE TO MASS RATIO IN A DEVELOPMENT STATION, all of which are hereby fully incorporated herein by reference. In this type of toning arrangement, the natural decay of charge intrinsic to the photoconductor is ignored and a median bias value is predetermined which gives satisfactory toning.

A controller 32 provides control signals to supply unit 30 to specify the bias voltage to be applied to the roller 18. Controller 32 is provided input by an operator through an operator panel located remotely from the supply, such as on the operator console of the imaging apparatus or a remote console which is connected to the imaging apparatus through a network.

A transfer unit 60 (see FIG. 3) transfers the toner developed on the photosensitive film 10 to a receiver, such as a printing paper (not shown).

A cleaning unit 22 removes toner still attached to the photosensitive film 10 after completion of the transfer process.

Figure 2:
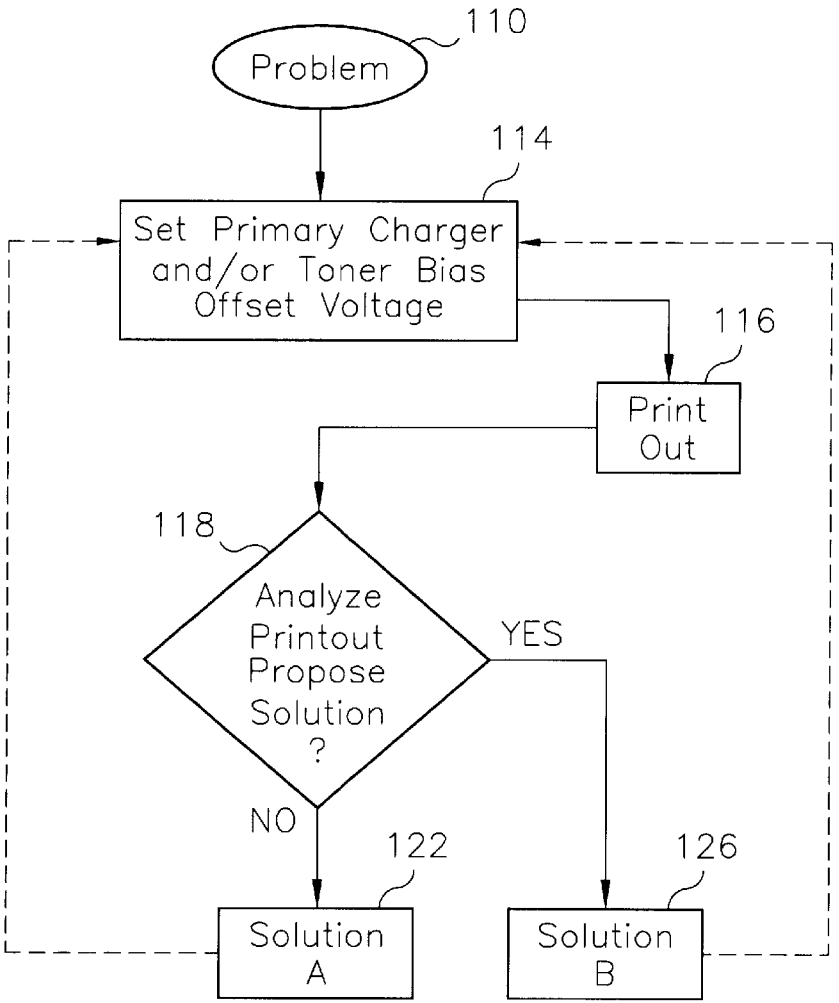
FIG. 2 is a flowchart for service diagnostics in accordance with the present invention.

Referring now to FIG. 2, wherein there is shown a typical diagnostic process or procedure which is performed utilizing a software program resident in the control system of the apparatus which interfaces or is part of the controller, and which is initiated by an operator. Alternatively, a service technician might perform these steps. In the procedure, a problem is detected in a step 110 on an image which is output from the imaging apparatus. The procedure would call out a next step 114 to adjust the primary charger and/or the toning bias offset voltage to a predetermined value to investigate that type of artifact. A step 116 would typically include transferring onto a receiving medium (such as paper) whatever latent toner image is resident on the film at the particular primary charger voltage and toner bias offset voltage for that test. In a next step 118, the operator would then analyze or read the receiving medium and diagnose what corrective action, if any, needs to be taken. A first solution might be attempted or suggested in a solution step 122 or a second solution might be attempted or suggested in a solution step 126.

It is to be appreciated, though, that steps 122, 126 may include additional diagnostic pathways. For example, they may encompass loops back to step 114 wherein the voltages are set to different values, and problem correction is again questioned. Alternatively, they may involve changing or checking other parameters of the imaging apparatus in order to further diagnose and/or suggest corrective action. In addition, the controller or operator may set a series of voltages and printouts repetitively in steps 114 and 116 and automatically print out a series of test sheets either in singular steps or in a series of steps so that the operator may have one or more printouts which have different images provided, wherein the images are resultant from different values of primary charging voltage and/or toner bias offset voltage. To this end, the controller or operator may also have the machine print out instructions on the image test sheets as to how the image should appear and what corrective action to take as a result of the actual image printed. In addition, the controller or operator may provide printed instructions in conjunction for artifacts found or seen with the test printouts which provide guidance to an operator as to what steps (122, 126) may be taken next or what parameters are to be observed.

The present invention therefore provides an electrophotographic print engine having a variable primary charger and toning bias offset in order to provide the necessary service and diagnostic information to troubleshoot all subsystems involved in the electrophotographic process. To this end, the present invention allows the electrophotographic process to be operated with parameters otherwise undesirable for the print production mode. Specifically, the photoconductor may be toned without using the exposure step. An operator can therefore use the output created to differentiate between exposure issues and other sources of process non-uniformity.

Bias offset ($\Delta V$) during the print production mode is usually fixed to optimize background and developer pick up (DPU) at $\Delta V=(V_o-V_{bias})=-110V$ or otherwise regulated to a relatively narrow offset voltage range of approximately $\Delta V=-110V\pm20V$. According to the present invention, the bias power supply is designed to deliver output voltages $V_{bias}$ exceeding the voltage range for the film voltage $V_o$ that are expected for all operating conditions of the employed electrophotographic process.

The present invention provides the means of adjusting both the toning station bias voltage $V_{bias}$ and the primary charger voltage yielding the film voltage $V_o$. To illustrate the application of the present invention, three ranges of Bias Offset Voltages $\Delta V=V_o-V_{bias}$ are identified in the following examples. It should be noted that the actual limits between the offset voltage ranges are not sharp but rather overlapping and that the actual voltage ranges may be different than those specified and that other ranges are within the purview of the present invention. The offset ranges given are most likely the voltage settings making imaging problems (image quality artifacts) visible in the areas indicated.

Furthermore, it is the intention of the present invention to provide the means of switching the toning station bias $V_{bias}$ to a level essentially equal to the imaging level (e.g. $V_o-110V$) in the print production mode. The bias interframe switching is enabled or disabled at the discretion of the service engineer. What is meant by interframe is the area of the electrophotographic film between latent toner images. The switching of the toning bias in the interframe (the area of the photoconductor in between image frames) of $V_{bias}$ essentially equal to $V_o-110V$ ($V_{bias}\cong V_o-110V$ is a typical print production mode) will prevent toning of the photoconductor in the interframe and thus, minimize toner contamination of the photoconductor, and subsequently the transfer roller and other elements such as the paper vacuum transport and pre-clean 40 (see FIG. 3) charger that are exposed to this excess toner in the interframe before the cleaning station removes it.

Range 1

Bias offset $\Delta V$ in a range of approximately −50 through +50 V (F,B see FIG. 4) with respect to film voltage $V_o$ (indicated by A see FIG. 4) is helpful to diagnose the status of the following parameters:

Charging Uniformity ($V_o$)

Toning Uniformity

Film Problems—Uniformity/Coating

Writer Uniformity

Background Problems

Photoconductor Cleaning (wear/contamination)

Since the film voltage $V_o$ is also adjustable, the background problems can be differentiated further. At high $V_o$, the background can be traced to dielectric breakdown of the photoconductor by comparing the locations of background on prints of the same frame. This is easiest to accomplish in the field by printing on transparencies. Random location of background would identify a toning station problem such as incorrect bias offset settings, $T_c$, oil contamination, developer life issues or erroneous electrometer readings provided to the printer logic and control unit.

Furthermore, in support of comparing prints on the same frame there are the means provided to mark the output image so as to identify the image location used on the photoconductor in the printing of the image. For flexible web-based photoconductors, this might be a mark (e.g. frame number) printed on the image itself. Timing of such marks is derived by the marking engine logic and control unit by synchronizing the output of said marks with the location of the film splice (or other unique feature) of the photoconductor.

Range 2

Bias offset $\Delta V$ in the range of approximately +50 through +150 V (range G, negative $V_0$) and approximately −50 through −150 V (range C, positive $V_0$) with respect to film voltage $V_o$ is helpful to diagnose the status of the following parameters:

Charging Uniformity ($V_o$)

Toning Uniformity

Writer Uniformity

It is to be noted that this voltage range includes the typical print production settings of the electrophotographic process. Observed artifacts can easily be reproduced with print production settings of the electrophotographic process allowing the most likely subsystem to be identified contributing or causing image artifacts.

Range 3

Bias offset $\Delta V$ in the range of approximately −50 through −400V (range H, negative $V_0$) and +50 through +400V (range D, positive $V_0$) with respect to film voltage $V_o$ is helpful to diagnose the status of the following parameters:

Toning Uniformity

Writer Uniformity

This range allows varying the level of toner density (D) laydown up to $D_{max}$ without using the writer. For the above mentioned toning bias interframe switching, the contamination of the photoconductor in the interframe (possibly up to $D_{max}$) is minimized.

Disabling interframe transfer-switching of the transfer roller 'on' or 'off' in this example allows the field engineer to identify the causes of this artifact and minimizes contamination.

Figure 3:
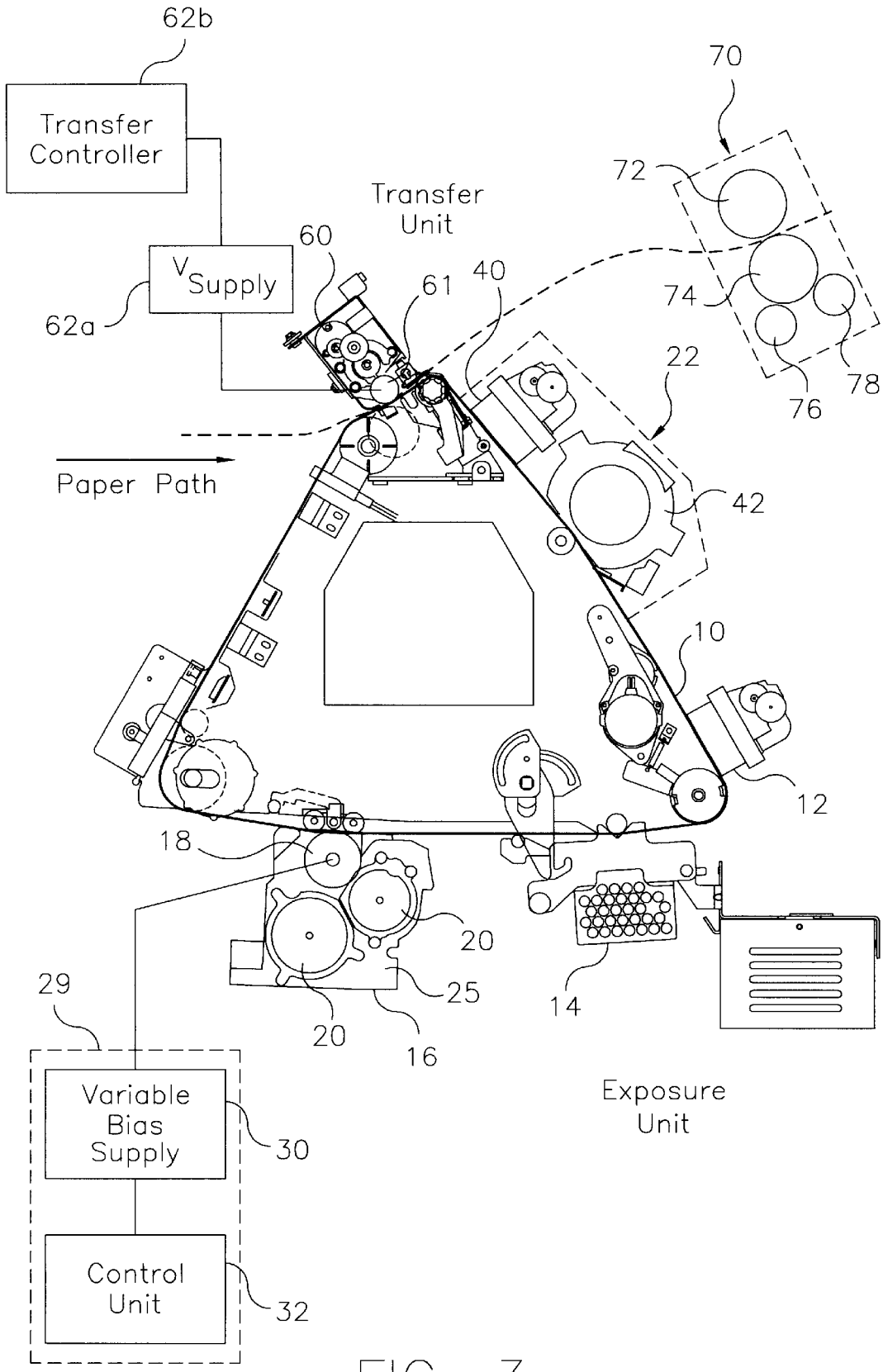
FIG. 3 is a second schematic diagram of an electrophotographic imaging apparatus in accordance with the present invention.

Referring now to FIG. 3, wherein an image forming apparatus according to the invention includes a photosensitive film 10 which serves as an image bearing member on which an electrostatic latent image is formed. A primary charger 12 provides a predetermined primary charging voltage $V_o$ to the photosensitive film 10 and an exposure unit 14 forms the electrostatic latent image on the film 10 by scanning light from an exposing light source. A developing unit 16 develops the electrostatic latent image formed on the photosensitive film.

A bias voltage control unit 29 may have two components, either combined or separate, including a variable developing bias supply unit 30 supplies a bias voltage to developing roller 18, thereby providing an electric field (a developing bias voltage) between the photoconductor 10 and the roller 18, which serves to enhance the migration of the toning particles from the roller to the surface of the photoconductor so that the toner selectively adheres to the surface of the photoconductor due to form a toner image according to the latent image.

Controller 32 provides control signals to supply 30 to specify the toner bias voltage to be applied to the roller 18. Controller 32 is provided input by an operator through an operator panel located remotely from the supply, such as on the operator console of the imaging apparatus or a remote console which is connected to the imaging apparatus through a network. The controller may also be controlled through a software program, such as a service software program.

A transfer unit 60 transfers the toner developed on the photosensitive film 10 to a receiver, such as paper. Transfer unit 60 includes a transfer roller 61 which is biased with a voltage from a power supply 62*a* controlled by a controller 62*b*. The voltage introduces an electric field into the transfer zone to induce the transfer of toner from the film to the receiver.

The present invention provides the means to disable and/or enable the interframe switching of the transfer roller. To minimize toner contamination on the transfer roller picked up, for example, from the splice or the process patch, the interframe voltage of the transfer roller is reversed. Such voltage reversal in interframes over extended use of the photoconductor can lead to different electrical characteristics of the photoconductor in the interframes. The switch of paper sizes within a normal print production run (e.g. insertion of 11×17 inch paper into a 8.5×11 inch paper) requires uniform imaging throughout the interframe.

For diagnostic purposes, though, the present invention provides for changing the normal print production transfer roller bias voltage scheme. The present invention contemplates that, during the interframe, the transfer roller bias voltage is either kept constant, reduced, or kept the same polarity as in the frames. This allows the field engineer to identify the causes of artifacts due to differences in photoconductor characteristics in the interframes.

A cleaning unit 22 removes the wasted toner attached to the photosensitive film 10 after completion of the transfer process of image to the receiver. Cleaning unit 22 is comprised of a cleaning assist or pre-clean charger 40 and a cleaning station 42.

After the image is transferred to the printing paper sheet or image receptor, the sheet is passed through a fuser assembly 70. Fusers generally comprise a pressure roller 72 and a fuser roller 74 between which the image receptor passes. The fuser roller, usually the bottom roller, is not as compressible as the pressure roller such that a nip is formed in the center of the contact length of the two rollers. The image receptor, while passing through the nip, traverses the arc of the less compliant roller and the two rollers compress the image receptor as it passes between the rollers. One or both of the rollers is heated so as the two rollers compress the image receptor the melted toner particles attached thereto are thereby fixed or fused to the image receptor. Oil is applied to the roller which makes direct contact with the plastic toner particles, so as to prevent the melted toner particles from adhering to the roller.

Examples of electrophotographic subsystems as described above are provided in the Digimaster® 9110 brand digital high volume printer manufactured by Heidelberg Digital L.L.C. of Rochester, N.Y.

Figure 4:
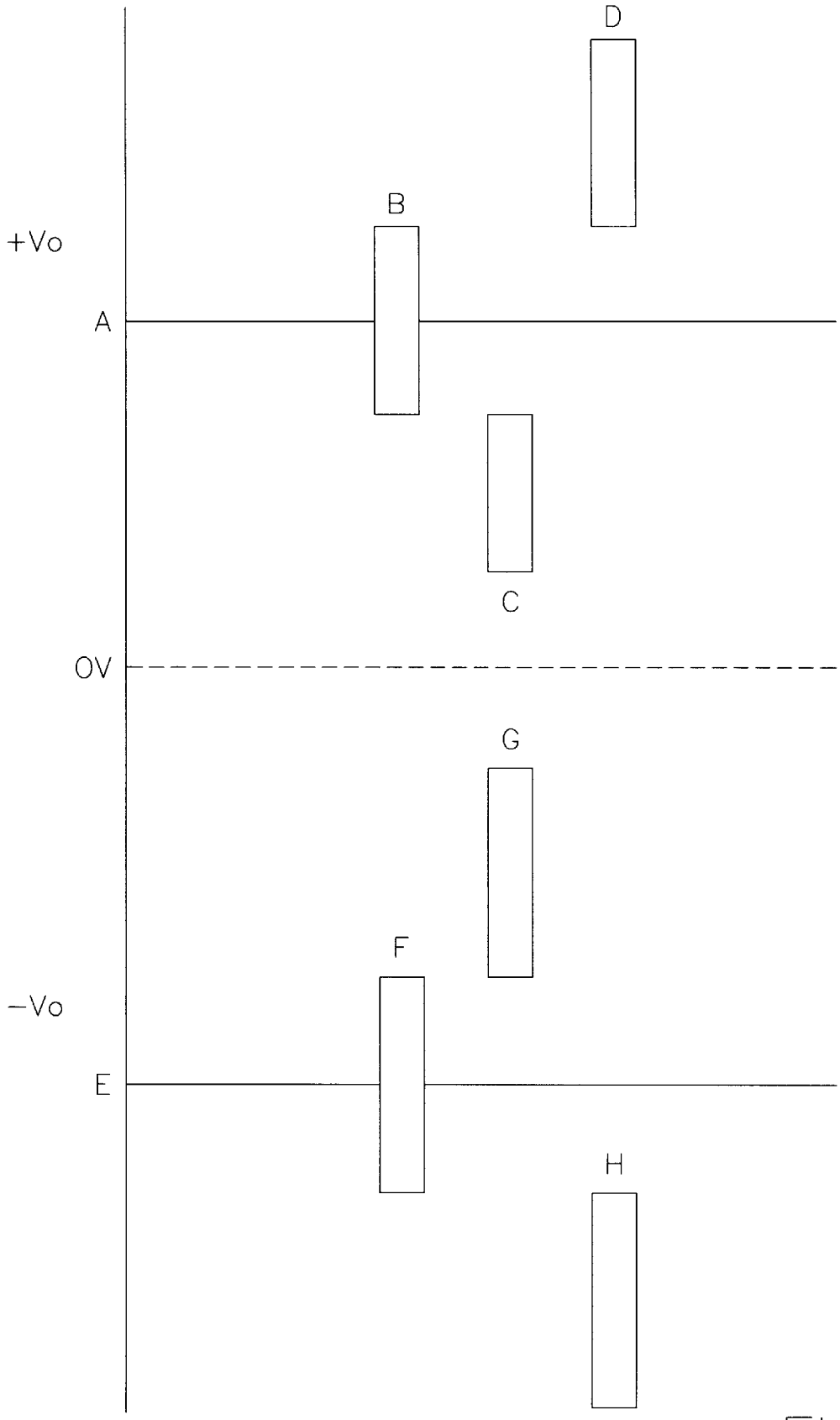
FIG. 4 is a chart showing examples operating an electrophotographic imaging apparatus in accordance with the present invention.

Referring now to FIG. 4, wherein examples of film voltages and toner bias voltages are provided for exemplary operating and diagnostic procedures.

The following examples A–D apply for electrophotographic films which are charged with a positive primary voltage.

In a first example A, a positive film voltage $V_0$ is provided, and which is (for exemplary purposes only) typically in the range of on the order of +300 to +800 VDC. The toner offset bias voltage $V_{Bias}$ during typical operation may be on the order of $V_0$−100 VDC.

In an example B, with the positive film voltage $V_0$ provided, (as in example A) the toner offset bias voltage $V_{Bias}$ may be varied by the bias controller on the order of $V_0$+/−50 VDC. Setting $V_{Bias}$ in this manner tones the film without exposure from the exposing subsystem. An operator could then look for background bias developing (and developer pick up).

In an example C, with the positive film voltage $V_0$ provided, (as in example A) the toner offset bias voltage $V_{Bias}$ may be varied by the bias controller on the order of $V_0$−50 VDC to $V_0$−150 VDC. Setting $V_{Bias}$ in this manner allows an operator to test for film discharge failure such as breakdown, kinking, scratches. Unlike example B, the film is not toned with this set up, but some of the image artifacts will be enhanced for evaluation.

In an example D, with the positive film voltage $V_0$ provided, (as in example A) the toner offset bias voltage $V_{Bias}$ may be varied by the bias controller on the order of $V_0$+50 VDC to $V_0$+400 VDC. Setting $V_{Bias}$ in this manner allows an operator to test for toning uniformity and developer pick up and also allows toning from minimum density $D_{min}$ to maximum density $D_{max}$ without exposure.

The following examples E–H apply for electrophotographic films which are charged with a negative primary voltage.

In an example E, a negative film voltage $V_0$ is provided, and which is (for exemplary purposes only) typically in the range of on the order of −300 to −800 VDC. The toner offset bias voltage $V_{Bias}$ during typical operation may be on the order of $V_0$+110 VDC.

In an example F, with the negative film voltage $V_0$ provided, the toner offset bias voltage $V_{Bias}$ may be varied by the bias controller on the order of $V_0$+/−50 VDC. Setting $V_{Bias}$ in this manner tones the film without exposure from the exposing subsystem. An operator could then look for background bias developing and developer pickup.

In an example G, with the negative film voltage $V_0$ provided, (as in example E) the toner offset bias voltage $V_{Bias}$ may be varied by the bias controller on the order of $V_0$+50 VDC to $V_0$+150 VDC. Setting $V_{Bias}$ in this manner allows an operator to test for film discharge failure such as breakdown, kinking, scratches. Unlike example F, the film is not toned, but some of the image artifacts will be enhanced for evaluation In an example H, with the negative film voltage $V_0$ provided, (as in example E) the toner offset bias voltage $V_{Bias}$ may be varied by the bias controller on the order of $V_0$−50 VDC to $V_0$−400 VDC. Setting $V_{Bias}$ in this manner allows an operator to test for toning uniformity and developer pick up up and also allows toning from minimum density $D_{min}$ to maximum density $D_{max}$ without exposure.

The present invention allows an operator to isolate contributions from various image formation steps from each other and identify the cause of degradation in print quality. Specifically, the program allows the printing of the full range of density at various film voltages $V_o$ without the exposure step. The output on standard or special receivers (e.g. transparencies) is aided by the possibility to print marks on the output allowing to identify the same locations of the photoconductor in a series of output prints. The interframe switching of the transfer voltage and of the toning bias voltage are enhancements to the basic concept.

As noted before, the controller of the present invention typically puts the imaging apparatus in a state which is not utilized for typical reproduction. In other words, the present invention sets the primary charging voltage and the toning offset bias voltage at values which are not used for normal operation in order that the health of the machine subsystems might be diagnosed.

Although the invention has been shown and described with exemplary embodiments thereof, it should be understood by those skilled in the art that the foregoing and various other changes, omissions and additions may be made therein and thereto without departing from the spirit and scope of the invention.

What is claimed is:

1. An image forming apparatus comprising:

a primary charger for providing a primary charging voltage on an image support;

an image support for supporting an electrostatic latent image on the surface thereof;

a developing unit having a developing agent support, the developing agent support retaining a developing agent, including toner and carriers, contained in the developing unit, and the developing unit converting the latent image on the image support into a toner image by causing the toner to adhere to the surface of the image support;

a developing bias supplying unit for supplying a developing bias voltage to the developing agent support of the developing unit; and, a controller for setting the developing bias voltage and primary charging voltage at predetermined values undesirable for normal image forming operation in order to provide diagnostic information on the image forming apparatus.

2. A method of operating an image forming apparatus comprising the steps of:

providing a primary charging voltage on an image support;

supporting an electrostatic latent image on the surface of the image support;

causing toner of a developing agent to adhere to the surface of the electrostatic latent image to thereby convert the latent image on the image support into a toner image;

supplying a developing bias voltage to the developing agent; and setting the developing bias voltage and primary charging voltage to predetermined values undesirable for normal image forming operation in order to provide diagnostic information on the image forming apparatus.

3. A method of operating an image forming apparatus in accordance with claim 1, wherein the setting step comprises setting the developing bias voltage higher than the primary charging voltage.

4. A method of operating an image forming apparatus in accordance with claim 1, wherein the setting step is controlled in a software routine in memory of a computer.

5. An image forming apparatus comprising:

a primary charger for providing a primary charging voltage on an image support;

an image support for supporting an electrostatic latent image on the surface of the image support;

a developing unit having a developing agent support, the developing agent support retaining a developing agent, including toner and carriers, contained in the developing unit, and the developing unit converting the latent image on the image support into a toner image by causing the toner to adhere to the surface of the image support;

a developing bias supplying unit for supplying a developing bias voltage to the developing agent support of the developing unit; and, a controller for setting the developing bias voltage and primary charging voltage;

wherein the controller is provided with service diagnostic hardware to set the developing bias voltage and primary charging voltage at predetermined values not used normally for imaging in order to provide diagnostic information.

6. A method of operating an image forming apparatus comprising the steps of:

providing a primary charging voltage on an image support;

supporting an electrostatic pattern on the surface of the image support;

causing toner of a developing agent to adhere to the surface of the electrostatic pattern to thereby convert the pattern on the image support into a latent toner image;

supplying a developing bias voltage to the developing agent; and setting the developing bias voltage to predetermined values undesirable for normal image forming operation in order to provide diagnostic information on the image forming apparatus.

7. A method of operating an image forming apparatus in accordance with claim 6, further comprising the step of:

setting the primary charging voltage to predetermined values in order to provide diagnostic information on the image forming apparatus.

8. A method of operating an image forming apparatus in accordance with claim 6, wherein the setting step is controlled in a software routine in memory of a computer.

9. An image forming apparatus comprising:

a primary charger for providing a primary charging voltage on an image support;

an image support for supporting an electrostatic latent image on the surface thereof;

a developing unit having a developing agent support, the developing agent support retaining a developing agent, including toner and carriers, contained in the developing unit, and the developing unit converting the latent image on the image support into a toner image by causing the toner to adhere to the surface of the image support;

a developing bias supplying unit for supplying a developing bias voltage to the developing agent support of the developing unit;

a transfer unit having a transfer bias voltage for inducing transfer of toner from the image support onto an image receptor, a transfer unit controller for controlling the transfer bias voltage and reversing the polarity of the transfer bias voltage between latent images on the image support during normal print production; and, a controller for setting the developing bias voltage and primary charging voltage at predetermined values and for keeping the transfer bias voltage one of either positive or negative polarity in order to provide diagnostic information.

10. A method of operating an image forming apparatus comprising the steps of:

providing a primary charging voltage on an image support;

supporting an electrostatic latent image on the surface of the image support;

causing toner of a developing agent to adhere to the surface of the electrostatic latent image to thereby convert the latent image on the image support into a toner image;

supplying a developing bias voltage to the developing agent;

supplying a transfer bias voltage to a transfer unit to induce transfer of toner from the image support onto an image receptor, reversing polarity of the transfer bias voltage between latent images on the image support during normal print production; and, setting the developing bias voltage and primary charging voltage to predetermined values and keeping the transfer bias voltage one of either positive or negative polarity in order to provide diagnostic information on the image forming apparatus.

11. An image forming apparatus comprising:

a primary charger for providing a primary charging voltage on an image support;

an image support for supporting an electrostatic latent image on the surface thereof;

a developing unit having a developing agent support, the developing agent support retaining a developing agent, including toner and carriers, contained in the developing unit, and the developing unit converting the latent image on the image support into a toner image by causing the toner to adhere to the surface of the image support;

a developing bias supplying unit for supplying a developing bias voltage to the developing agent support of the developing unit;

a transfer unit having a transfer bias voltage for inducing transfer of toner from the image support onto an image receptor; and, a controller for setting the developing bias voltage and primary charging voltage to predetermined values and keeping the transfer bias voltage one of either positive or negative polarity in order to provide diagnostic information on the image forming apparatus.

12. A method of operating an image forming apparatus in accordance with claim 2, 6, or 10 wherein the setting step comprises setting the bias voltage higher than the primary charging voltage.

13. A method of operating an image forming apparatus in accordance with claim 2, 6, or 10, further comprising the step of setting the developing bias voltage to on the order of −110V from the primary charging voltage between latent images on the image support.

14. A method of operating an image forming apparatus in accordance with claim 2, 6, or 10, further comprising the step of setting the developing bias voltage to normal print production levels between latent images on the image support.

15. An image forming apparatus in accordance with claim 1, 5, 9, or 11 wherein the developing bias voltage is set higher than the primary charging voltage.

16. An image forming apparatus in accordance with claim 1, 5, 9, or 11 wherein the developing bias voltage is set to on the order of −110V from the primary charging voltage between latent images on the image support.

17. An image forming apparatus in accordance with claim 1, 5, 9, or 11 wherein the developing bias voltage is set to normal print production levels between latent images on the image support.

18. An image forming apparatus comprising:

a primary charger for providing a primary charging voltage on an image support;

an image support for supporting an electrostatic latent image on the surface thereof;

a developing unit having a developing agent support, the developing agent support retaining a developing agent, including toner and carriers, contained in the developing unit, and the developing unit converting the latent image on the image support into a toner image by causing the toner to adhere to the surface of the image support;

a developing bias supplying unit for supplying a developing bias voltage to the developing agent support of the developing unit;

a transfer unit having a transfer bias voltage for inducing transfer of toner from the image support onto an image receptor, a transfer unit controller for controlling the transfer bias voltage and reversing the polarity of the transfer bias voltage between latent images on the image support during normal print production; and, a controller for setting the developing bias voltage and primary charging voltage at predetermined values and for reducing the transfer bias voltage between latent images on the image support in order to provide diagnostic information.

19. A method of operating an image forming apparatus comprising the steps of:

providing a primary charging voltage on an image support;

supporting an electrostatic latent image on the surface of the image support;

causing toner of a developing agent to adhere to the surface of the electrostatic latent image to thereby convert the latent image on the image support into a toner image;

supplying a developing bias voltage to the developing agent;

supplying a transfer bias voltage to a developing agent transfer unit to induce transfer of toner from the image support onto an image receptor, reversing polarity of the transfer bias voltage between latent images on the image support during normal print production; and, setting the developing bias voltage and primary charging voltage to predetermined values and reducing the transfer bias voltage between latent images on the image support in order to provide diagnostic information on the image forming apparatus.

* * * * *